United States Patent [19]

Hoover

[11] 4,417,369

[45] Nov. 29, 1983

[54] CONTROL ROLL FOR STAPLE FIBERS

[76] Inventor: Donald R. Hoover, Rte. 3, Ratchford Rd., Gastonia, N.C. 28052

[21] Appl. No.: 319,319

[22] Filed: Nov. 9, 1981

[51] Int. Cl.[3] ..... D01H 5/00

[52] U.S. Cl. ..... 19/258; 19/259

[58] Field of Search ..... 19/236, 258, 259

[56] References Cited

U.S. PATENT DOCUMENTS

| | | | |
|---|---|---|---|
| 1,973,583 | 9/1934 | Stone | 19/259 |
| 2,107,818 | 2/1938 | Elzer | 19/236 |
| 2,728,954 | 1/1956 | Holdsworth | 19/236 |
| 2,740,996 | 4/1956 | Dudley et al. | 19/236 |
| 4,112,548 | 9/1978 | Sauvage | 19/258 |
| 4,347,647 | 9/1982 | Brown et al. | 19/258 X |

FOREIGN PATENT DOCUMENTS

| | | | |
|---|---|---|---|
| 26013 | 7/1923 | France | 19/236 |

*Primary Examiner*—Louis Rimrodt
*Attorney, Agent, or Firm*—Clifton Ted Hunt

[57] ABSTRACT

A control roll is provided for use in the processing of staple fibers and comprises a plurality of radially and circumferentially spaced projections on the surface of a roll. The control roll is placed in the path of a strand of fibers and the individual fibers in the strand are physically oriented into parallel relation with one another and maintained in that relation until the fibers are processed as by drawing and twisting.

7 Claims, 18 Drawing Figures

FIG. 14
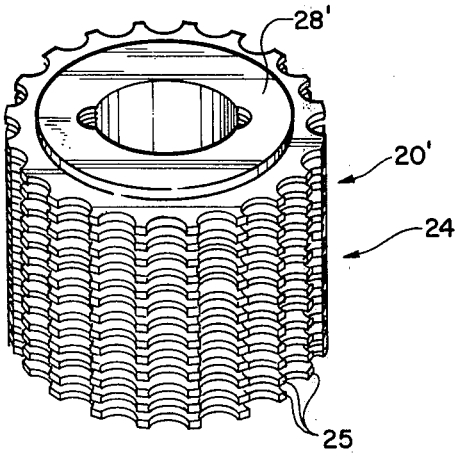
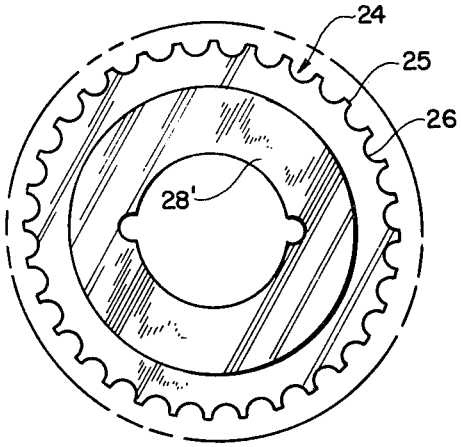
FIG. 15
FIG. 16
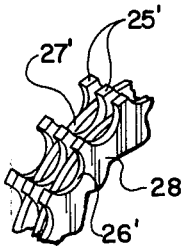

CONTROL ROLL FOR STAPLE FIBERS

BACKGROUND OF THE INVENTION

The processing of staple fibers include several steps all directed toward the orientation and maintenance of the fibers in eveness and in parallel relation to one another. Eveness is a term used to define the desired uniformity of fiber diameter without thick and thin places along its length.

More specifically, the processing of staple fibers includes carding clumps or tufts of cotton or synthetic staple. The carding action separates these clumps or tufts into their individual fiber elements, thereby exposing and removing bits of foreign matter enclosed by the unopened fiber aggregates and feeds the cleaned disentangled fibers through the tapered hole or trumpet to define a continuous untwisted strand of fibers known as sliver. The compression of the fibers at the trumpet and calendar rolls of the carding machine causes fibers to be loosely held together to form the sliver. The size of sliver is expressed as the average weight in grains per yard of length, there being seven thousand grains in one pound. The normal range of sliver weights is from 40 to 70 grains per yard.

The card sliver may be delivered to a draw frame which progressively passes or slides fibers by each other, causing a reduction in size of the strand, but not breaking its continuity. The action is obtained by using several pairs of rolls running at different speeds. The purpose of all roller drawing is to straighten the fibers being treated and to reduce the size of the strand which they compose. The straightening is important because it arranges the fibers more nearly parallel to each other and to the direction of the strand. When the fibers are well straightened, the arrangement helps in producing uniform, strong, and smooth yarn.

The placement of the rolls must be adjusted to suit the length of the fibers being handled. Although the fibers of any given cotton are not uniform in length, the drawing rolls must control as many of the fibers as possible. This means that there are fibers longer and shorter than those for which the rolls are set, and those longer and shorter fibers will not be well controlled. The imperfect control of fibers in the drawing leads to uneveness in the strand, producing irregularities or thick and thin places which contribute to uneveness in the finished product. Conversely, the more perfect control of fibers in the drawing leads to eveness of the strand which contributes to the desired uniformity of the finished product.

The sliver is reduced in diameter by successive drafting and is processed on a spinning frame to provide additional drafting and twisting to produce the desired yarn.

Prior attempts have been made to control the fibers on the draw frame, roving frame and spinning frame including the use on draw frames and roller drafters of a saw-tooth roll with teeth extending at a positive angle to pull the fibers and separate them into spaces between the teeth. The pulling of the fibers by the positively angled saw-teeth is objectionable because it disorients the previous parallelization of the fibers. Balloon rolls have been used and they provide effective tension and maintenance of the yarns. The same is true of the prior art aprons comprising endless rubber belts extending around a special cradle on a spinning frame, known as the Casablanca system, and so arranged that the fibers on the spinning frame are fed between the aprons at their nip. The aprons satisfactorily control the fibers but are objectionable because of the need for frequent replacement. Another objection of the Casablanca system is its expense. The Casablanca system includes special stands for holding the front and back rolls on the spinning frame and the middle bottom roll is of special design with narrow bosses, each of which carries a short endless apron. The middle top rolls, the bosses of which are smaller in diameter than regular top rolls, are also narrow and each boss carries a short, endless apron like those on the bottom roll. It has been estimated that the cost of these special rolls and aprons amounts to 70% of the cost of a conventional spinning frame.

SUMMARY OF THE INVENTION

The control roll of the present invention is a metal roll with a novel circumferential surface configuration comprising teeth, axial channels and circumferential grooves uniformly spaced from each other circumferentially, radially, and axially. The teeth extend at a negative angle from the body of the roll and are axially and circumferentially spaced from each other.

In use, the control roll of the present invention is placed between two sets of calender rolls in a slightly elevated position. The spacing of the control roll between the calender rolls is preferably slightly less than the average staple length of the fiber being processed. The sliver or roving is trained upwardly over the control roll from the first calender roll set and then trained downwardly through the nip of the second calendar roll set. There is a differential in the rotational speed of the calender rolls and the control roll and this speed differential moves the fibers into engagement with the teeth which feed the fibers into the axially spaced circumferentially extending grooves on the control roll which tend to straighten the tensioned fibers as they are drawn into the axially spaced grooves of the control roll, whereby the control roll exerts a positive control on the sliver and orients and maintains the fibers in both eveness and parallelization.

The control roll is preferably used at each drafting station after the carding operation, that is on drafter rollers, draw frames, roving frames and spinning frames. It is placed between two calender rolls in each instance and on the spinning frame the control roll of the present invention replaces the Casablanca system including the aprons and special shafts for the middle top roll and middle bottom roll. In fact, the entire middle top roll may be eliminated and the special knurling and other features necessary for the Casablanca system is eliminated by the present invention. The control roll of this invention is mounted on a standard keyed shaft, there being a separate control roll for each strand of sliver spaced along the standard shaft which may be supported about even ten feet.

It is, accordingly, an object of the present invention to provide a control roll with a circumferential surface configuration arranged to exert a positive control on sliver or roving and orient and maintain the fibers in both eveness and in parallelization.

It is another object of the invention to provide a control roll of the type described which is split and assembled on the shaft by bolts so individual rolls can be replaced without taking off the entire shaft.

It is another objection of this invention to provide a control roll of the type described which will more effectively orient and maintain the orientation of the fibers during drafting than has heretofore been possible.

It is a still further object of the invention to provide a control roll which will effectively control the fibers during drafting with greater efficiency and economy than has heretofore been possible.

BRIEF DESCRIPTION OF THE DRAWINGS

FIG. 3B is a vertical sectional view taken substantially along the line 3B—3B in FIG. 3A;

FIG. 14 is a perspective view of a third embodiment of the control roll;

FIG. 15 is a top plan view of the control roll shown in FIG. 14 and illustrating in phantom lines alternative annular flanges on the ends of the roll; and FIG. 16 is a fragmentary view of a fourth embodiment of the control roll, illustrating an alternative arrangement of the grooves and channels.

DETAILED DESCRIPTION OF THE INVENTION

Figure 1:
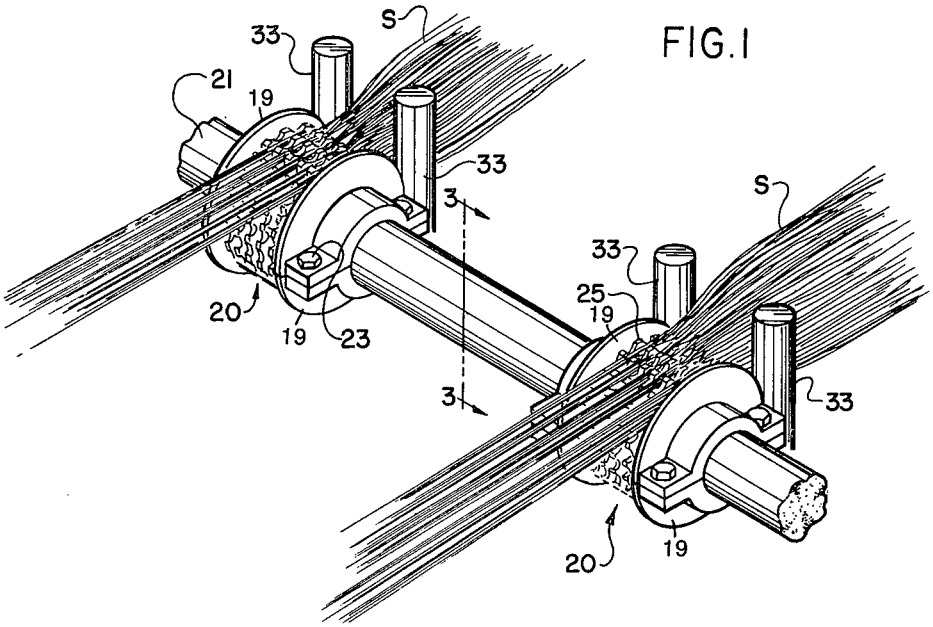
FIG. 1 is a perspective view of a control roll assembly according to the present invention.
Figure 2:
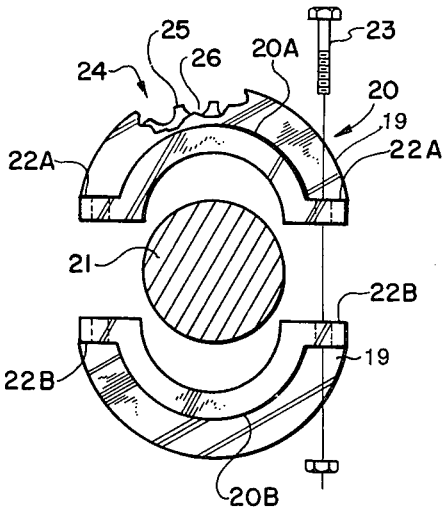
FIG. 2 is an exploded sectional view of one of the control rolls shown in FIG. 1.

Referring more specifically to the drawings, the control roll of this invention is broadly indicated at 20. A separate control roll 20 is provided for each strand of sliver on a processing machine such as the roller drafter shown in FIG. 5 and 6 or the spinning frame illustrated in FIGS. 7 and 8. Two control rolls 20 are suitably keyed and removably mounted on a correspondingly shaped driven shaft 21 in FIG. 1 to define a control roll assembly.

Each roll 20 is preferably split along its axis to provide equally sized and shaped roll segments 20A and 20B in the form of invention illustrated in FIGS. 1 through 11. Each of the roll sections 20A and 20B are of identical construction and include arcuate flanges or shoulders formed integral therewith and projecting axially from their ends and respectively indicated at 22A and 22B. The segments 20A and 20B are assembled about a shaft 21 and retained thereabout by pins or bolts 23 which penetrate juxtaposed flanges 22A and 22B as clearly shown in FIG. 2. The segmental construction of the control roll enables it to be replaced when needed without disturbing the remaining control rolls on the same shaft and is deemed desirable for this reason. It is contemplated, however, that there are instances where a monolithic control roll such as broadly indicated at 20' in FIG. 14 may be desirable and it is within the scope of the invention to make the control roll either segmental as shown in FIG. 1 through 8 or monolithic or unitary as shown in FIG. 14. The shaft 21 is preferably keyed as at 21A and one of the segments 20A or 20 and the roll 20' are correspondingly shaped to prevent slippage.

Whether segmental or monolithic, the control roll 20 and 20' each includes a circumferentially textured work surface 24 comprising teeth 25 spaced axially and circumferentially from each other and defining axially extending channels 26 and circumferentially extending grooves 27 there between. The peaks 25, channels 26 and circumferential grooves 27 are formed about the circumference of an arcuate body portion 28 in FIGS. 3A and 3B or a tubular body portion 28' in FIGS. 14, 15 and 16.

Figure 3:
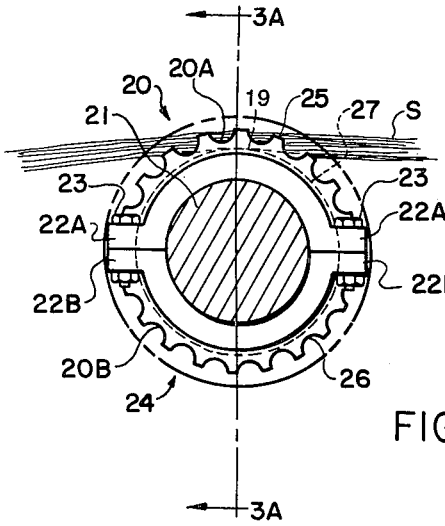
FIG. 3 is a vertical sectional view taken substantially along the line 3—3 in FIG. 1.
Figure 3A:
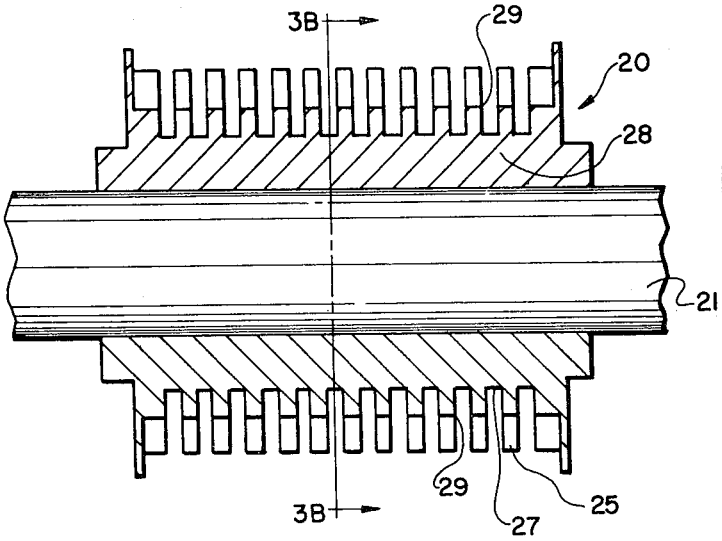
FIG. 3A is a vertical sectional view substantially along the line 3A—3A in FIG. 3.

Viewed circumferentially, as seen in FIG. 3A, the teeth 25 taper inwardly and upwardly from their junctures with the body portion 28 so that the base of each tooth has a greater axial dimension than the top of the tooth. The circumferential grooves 27 are shown in FIGS. 3, 3A and 3B as being deeper than the axial channels 26. Alternatively, as seen in FIG. 16, the axial channels 26 may be deeper than the circumferential grooves. In both instances the teeth 25 feed the staple fibers into the circumferential grooves 27 which physically arrange the fibers in parallel relation to each other as they are delivered from the control roll. The axial channels 26 assist in preventing lap-ups and have an arcuate configuration which provides a negative pitch to the teeth 25. The negative pitch is desirable because it prevents the teeth from plucking and disorienting the fibers as the fibers approach and leave the control roll. The work surface 24 is bounded by annular flanges 19 between the work surface 24 and the shoulders 22A, 22B. The flanges 19 direct all of the sliver to the control roll.

Figure 6:
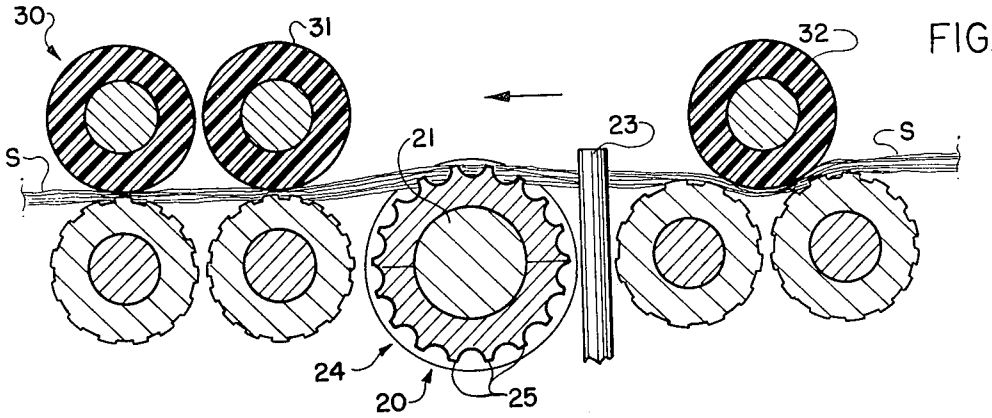
FIG. 6 is an enlarged horizontal sectional view taken substantially along the line 6—6 in FIG. 5.
Figure 5:
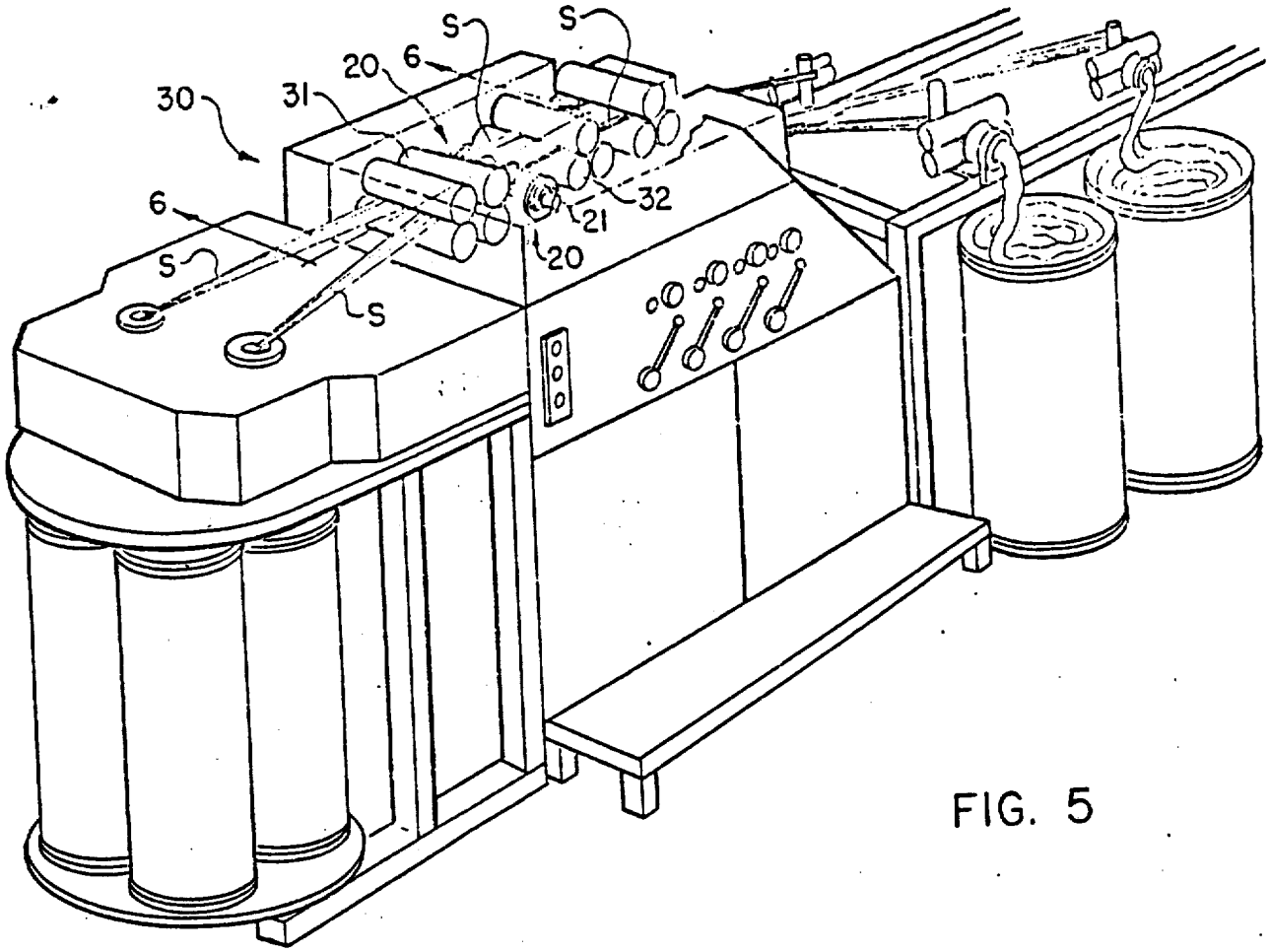
FIG. 5 is a perspective view of a roller drafter illustrating the control roll assembly of FIG. 1 between two sets of calender rolls.

In FIGS. 5 and 6, the driven shaft 21 and its control rolls 20 are mounted on a roller drafter 30 between calender rolls 31 and 32. The sets of calender rolls 31 and 32 are conventional and apply heavy pressure to the sliver as the sets are rotated at different speeds to draw the sliver by passing or sliding fibers by each other, causing a reduction in the size of the strand but not breaking its continuity. The roller drafter straightens the fibers being treated and reduces the size of the strand which they compose. The straightening is important because it arranges the fibers more nearly parallel to each other and to the direction of the strand which they compose. The straightening is important because it arranges the fibers more nearly parallel to each other and to the direction of the strand, indicated by the arrow in FIG. 6. When the fibers are well straightened, the arrangement helps in producing uniform strong and smooth yarn. The imperfect control of fibers in the drawing leads to uneveness in the strand, producing irregularties resulting in poor quality yarn. As more fibers are controlled in drawing the quality of the finished yarn is improved.

The several sets of calender rolls on the drafter roller illustrated in FIGS. 5 and 6 are spaced from each other along the direction of travel of the sliver a distance less than the average length of the fibers composing the sliver. Thus, assuming a staple length of one and one-half inches the calender rolls may be spaced one inch from each other and the control roll 20 spaced one inch from adjoining calender rolls. The diameter of the control roll 20 should be as great as the length of the fiber or staple plus at least 10 percent. For processing one and one-half inch sliver, a control roll having a diameter of two inches is satisfactory.

The calender rolls 31 and 32 rotate at different speeds with the calender roll 31 rotating at a faster speed than the calender roll 32. Similarly, the control roll 20 rotates at a faster speed than the rear calendar roll 32. For exampley, the first calender roll 32 may rotate at 10 rpm, the control roll 20 at 12 rpm and the last calender roll 31 at 100 rpm. Generally, the differential in speed between the first calender roll 32 and the control roll 20 is between 15 and 50 percent, at 20 percent differential being common.

The circumference of the control rolls 20 extends above the common plane occupied by the nips of the proximal sets of calender rolls 31 and 32 (FIG. 6) so that the sliver is moved upwardly as it reaches the control roll 20 and downwardly as it leaves. An elevational differential of 1/16 of an inch has been found satisfactory. The purpose is to move the fibers into the circumferential grooves 27. The teeth 25 feed the fibers to the circumferential grooves 27 and the grooves 27 condense and straighten the fibers as they traverse the control roll 20.

Figure 4:
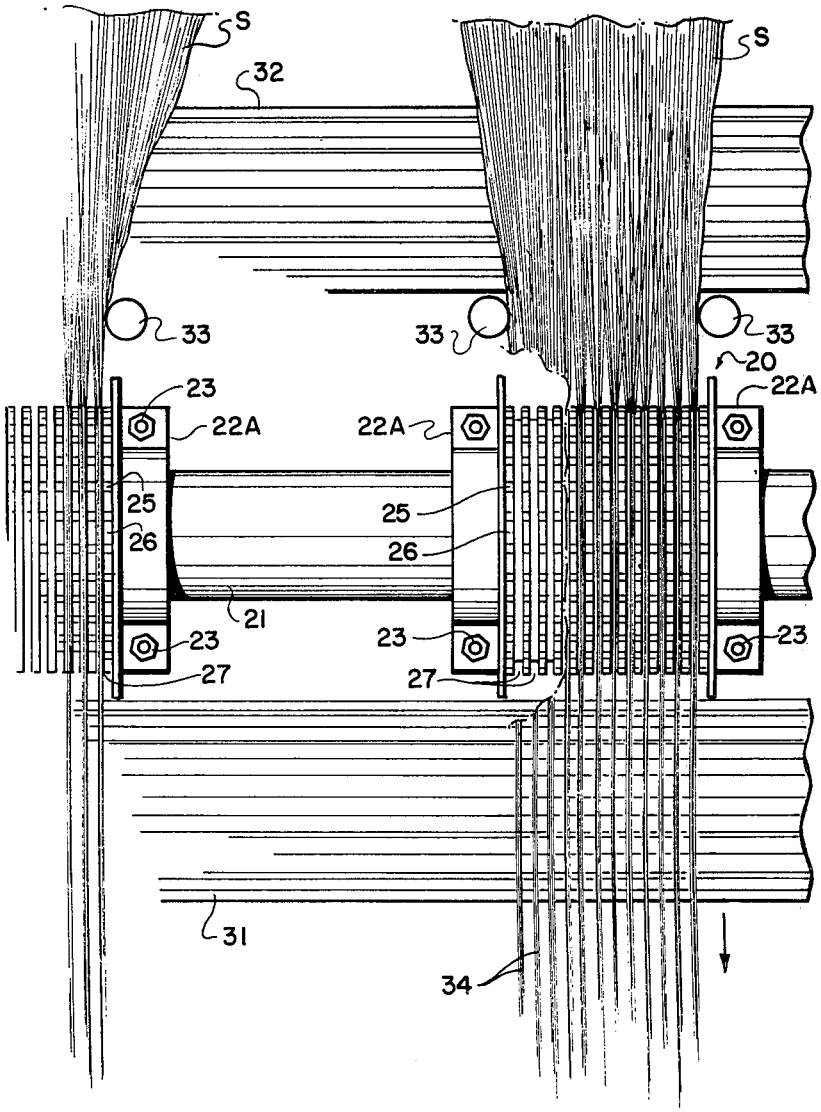
FIG. 4 is a fragmentary top plan view of the control roll assembly shown in FIG. 1 positioned between two calender rolls, the upper roll being omitted for clarity.

The sliver is initially condensed by vertical pins 33 in advance of the control roll 20. FIG. 4 illustrates the initial condensing of the sliver by the pins 33 and the subsequent condensing of the sliver by the pins 33 and the subsequent condensing of the sliver into small individual strands 34 by the control roll 30. The negative pitch of the teeth enables the teeth to guide the fibers into the circumferential grooves 27 without picking at the fibers and unnecessarily clumping them and disturbing the parallelization that they have previously obtained. The negative pitch of the teeth 25 also enables the fibers to leave the control roll without being plucked out of alignment by the teeth 25.

Figure 7:
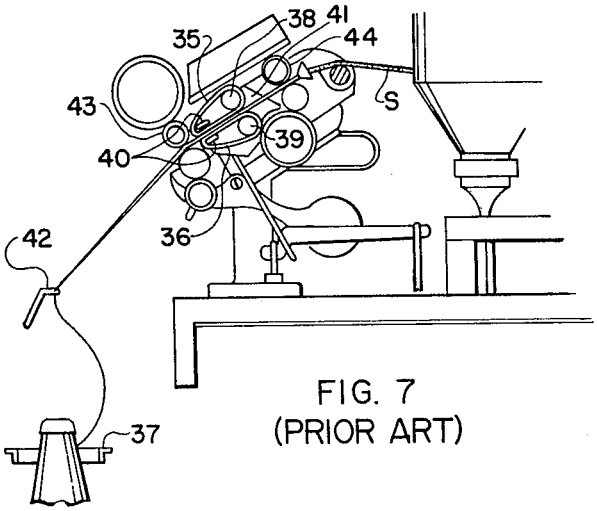
FIG. 7 (PRIOR ART)
FIG. 7 is a fragmentary somewhat schematic side elevation of a spinning frame, with parts broken away, equipped with the prior art aprons of the Casablanca system.
Figure 8:
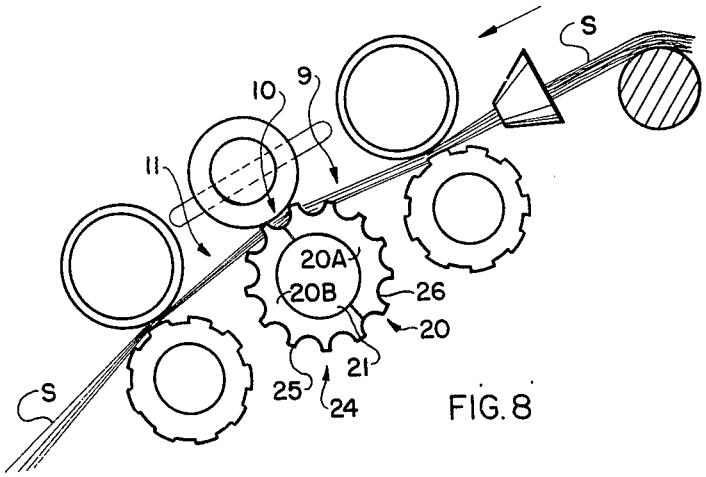
FIG. 8 is an enlarged fragmentary schematic side elevation of a spinning frame, with parts broken away, equipped with the control roll of the present invention instead of the prior art aprons.

Referring to FIGS. 7 and 8, a prior art spinning frame is illustrated in FIG. 7 with its upper and lower aprons 35 and 36 between which the sliver S passes toward the spinning ring 37. The endless belts of the aprons 35 and 36 are driven by upper and lower knurled rolls 38 and 39 about bars 40 supported by upper and lower knurled rolls 38 and 39 about bars 40 supported by a special metal cradle 41. The aprons 35 and 36 apply yieldable tension to the sliver and control the fibers during their passage through the drafting portion of the spinning frame prior to delivery to the ring twister 37 through the pigtail 42. The knurling of the rolls 38, 39 is an expensive procedure and the need for periodic replacement of the aprons 35 and 36 causes unproductive downtime and is expensive maintenance.

According to the present invention the need for knurling the rolls and the need for replacing the aprons is obviated by substituting the control roll 20 for the aprons 35 and 36 and substituting the driven shaft 21 for the knurled roll 39. The shaft 21 is a simple plain keyed shaft. The control roll 20 tensions the sliver and at the same time positively parallelizes the fibers, which the aprons of the prior art didn't do. The control roll 20 occupies the same position on the spinning frame as the prior art aprons, between sets of calender rolls 43 and 44 driven at different speeds. For example, the rear set of rolls 44 may rotate at 3 revolutions per minute; the control roll at 5 revolutions per minute; and the front rolls at 100 revolutions per minute. The circumference of the control roll 20 extends above the plane occupied by the nips of the calender rolls 43 and 44 to desirably locate the circumferential grooves 27 in the path of travel of the slivers. A guide roll 45 is mounted above the control roll 22 in FIG. 8 and is adjustable forwardly and rearwardly along a track schematically illustrated at 46 as desired depending on the fiber being processed.

Figure 9:
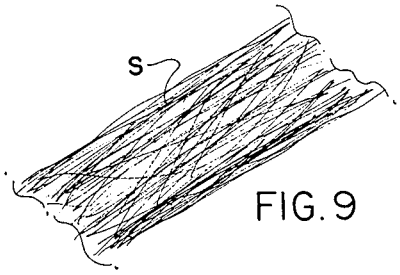
FIG. 9 is a perspective view of the sliver in advance of the control roll looking in the direction of the arrow 9 in FIG. 8.
Figure 10:
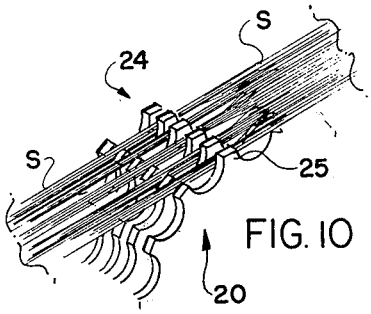
FIG. 10 is a perspective view of the sliver engaging the control roll looking in the direction of the arrow 10 in FIG. 8, and omitting the pressure roll for clarity.
Figure 11:
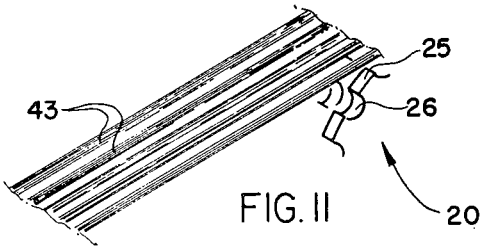
FIG. 11 is a perspective view of the sliver as it leaves the control roll and looking in the direction of the arrow 11 in FIG. 8.

FIGS. 9, 10 and 11 illustrate, repsectively, the condition of the sliver S in advance of the control roll 20; as it traverses the control roll; as it leaves the control roll 20. The sliver is condensed into individual strands 47 by the control roll 20, the individual strands 47 in FIG. 11 corresponding to the individual strands 34 in FIG. 4.

Figure 13:
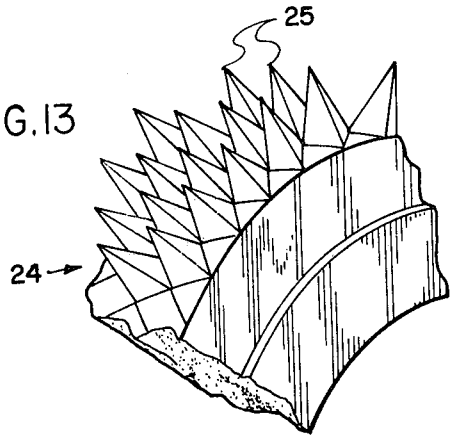
FIG. 13 is fragmentary perspective view of the control roll shown in FIG. 12, with parts broken away.
Figure 12:
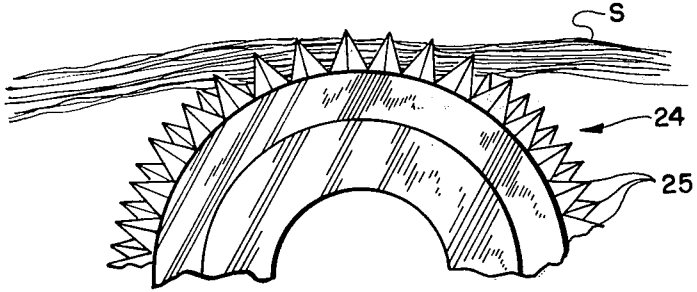
FIG. 12 is a fragmentary side elevation of a second embodiment of the control roll, with parts broken away.

Referring to FIGS. 12 and 13, a modified form of control roll is illustrated wherein the teeth 25' are each in the form of a pyramid with the point of the pyramid defining the top of the teeth and the teeth arranged in staggered rows about the circumference of the roll. Such a construction is preferable for use with certain fibers.

There is thus provided a control roll for exerting positive control on sliver to both orient and maintain the fibers in eveness and in parallel relation to improve the quality of the sliver and the resulting yarn. Although specific terms have been employed in the description of the invention they are used in an explanatory sense and not for purposes of limitation.

I claim:

1. In a fiber processing machine having at least two sets of calendar rolls rotating at different speeds and with the nips of the calendar rolls lying in a common plane, the combination of a control roll positioned between the sets of calender rolls and mounted against relative rotation on a driven shaft with the circumference of the control roll extending above the said plane, a circumferentially textured surface on the control roll including a plurality of teeth projecting radially from the control roll at a negative angle, and having a plurality of axially spaced circumferentially extending grooves between the teeth.

2. A structure according to claim 1 wherein the textured surface has a plurality of axially extending channels between the teeth.

3. A structure according to claim 2 wherein said channels are of arcuate cross-sectional configuration.

4. A structure according to claim 2 wherein the circumferentially extending grooves are deeper than the axially extending channels.

5. A structure according to claim 2 wherein the axially extending channels are deeper than the circumferentially extending grooves.

6. A structure according to claim 1 wherein the control roll is of segmental construction.

7. A structure according to claim 1 wherein the control roll is of monolithic construction.

* * * * *

UNITED STATES PATENT AND TRADEMARK OFFICE

CERTIFICATE OF CORRECTION

PATENT NO. : 4,417,369

DATED : November 29, 1983

INVENTOR(S) : Donald R. Hoover

It is certified that error appears in the above-identified patent and that said Letters Patent is hereby corrected as shown below:

Figures 3B and 5 of the drawings as originally filed are added to the patent as shown on the attached sheets.

Signed and Sealed this

Twenty-fifth Day of October, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,417,369

DATED : November 29, 1983

INVENTOR(S) : Donald R. Hoover

It is certified that error appears in the above-identified patent and that said Letters Patent is hereby corrected as shown below:

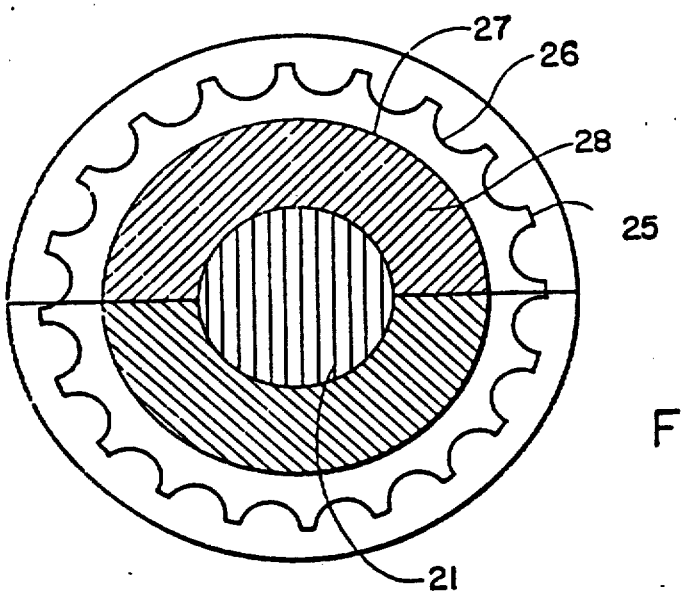

FIG. 3B

Patent No. 4,417,369

November 29, 1983

Donald R. Hoover